US005461754A

United States Patent [19]

Tillmann et al.

[11] Patent Number: 5,461,754

[45] **Date of Patent: * Oct. 31, 1995**

[54] DOOR CLOSER WITH A DETENT FOR HOLDING A DOOR OPEN AND THE DETENT THEREFOR

[75] Inventors: Horst Tillmann; Dietrich Jentsch, both of Ennepetal; Thomas Hering, Wetter; Thomas Warschewitz, Enneptal; Dieter Sichelschmidt, Herdecke; Bernd Winkler, Breckerfeld, all of Germany

[73] Assignee: DORMA GmbH + Co. KG, Ennepetal, Germany

[ * ] Notice: The portion of the term of this patent subsequent to May 17, 2011, has been disclaimed.

[21] Appl. No.: 168,528

[22] Filed: Dec. 15, 1993

Related U.S. Application Data

[62] Division of Ser. No. 931,281, filed as PCT/DE90/00962, Dec. 13, 1990, Pat. No. 5,311,642.

[51] Int. Cl.[6] ..... E05F 5/02

[52] U.S. Cl. ..... 16/82; 16/86 B; 16/65

[58] Field of Search ..... 16/82, 84, 86 B, 16/65, 70, 80, DIG. 17; 292/268, 275, 277

[56] References Cited

U.S. PATENT DOCUMENTS

| | | | |
|---|---|---|---|
| 1,101,859 | 6/1914 | Lambert | 292/275 |
| 1,942,860 | 1/1934 | Hummert . | |
| 3,164,032 | 1/1965 | Abbey . | |
| 3,986,742 | 10/1976 | Heaney . | |
| 4,506,407 | 3/1985 | Downey | 16/DIG. 17 |

FOREIGN PATENT DOCUMENTS

| | | |
|---|---|---|
| 1432653 | 9/1965 | France . |
| 2018887 | 10/1979 | United Kingdom . |

*Primary Examiner*—Mark Rosenbaum
*Assistant Examiner*—Chuck Y. Mah
*Attorney, Agent, or Firm*—Nils H. Ljungman & Associates

[57] ABSTRACT

A door closer being affixable to a door for closing the door. A channel having a slide therein for engaging with a detent also in the channel for holding the door open. The slide is connected to an arm of the door closer which arm moves the slide along the channel into contact with the detent which holds the door open once the detent and the slide have engaged with one another.

19 Claims, 8 Drawing Sheets

Fig. 10
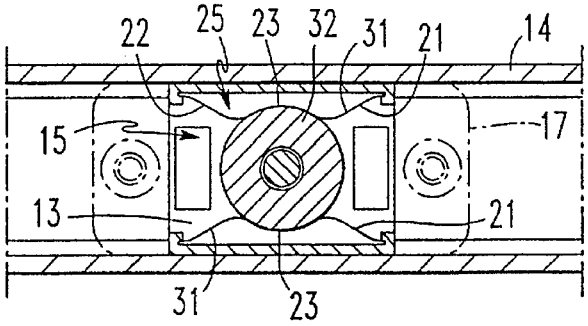
Fig. 11
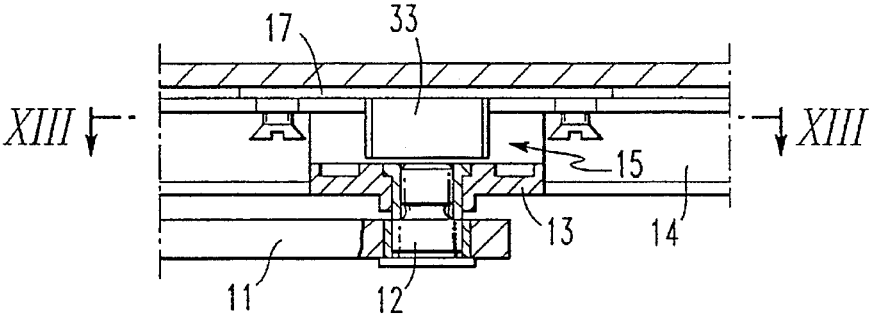
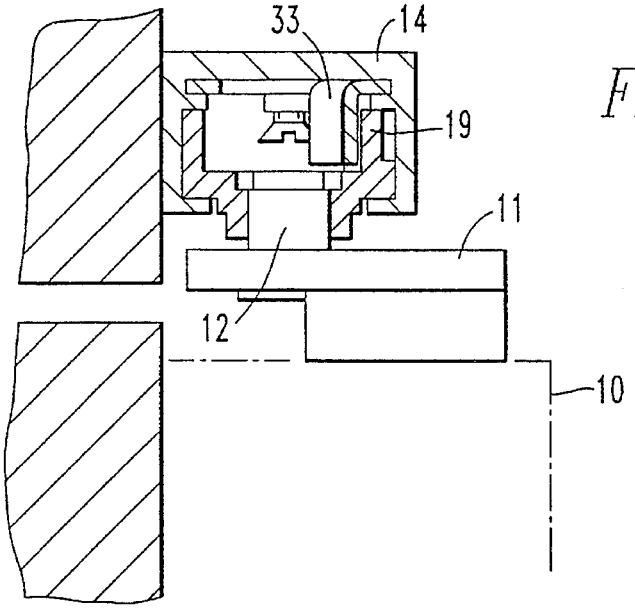
Fig. 12

Fig. 13
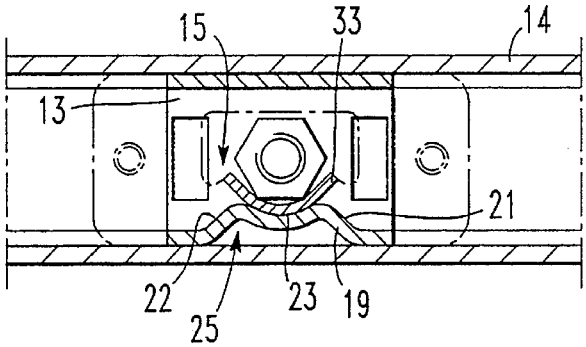
Fig. 14
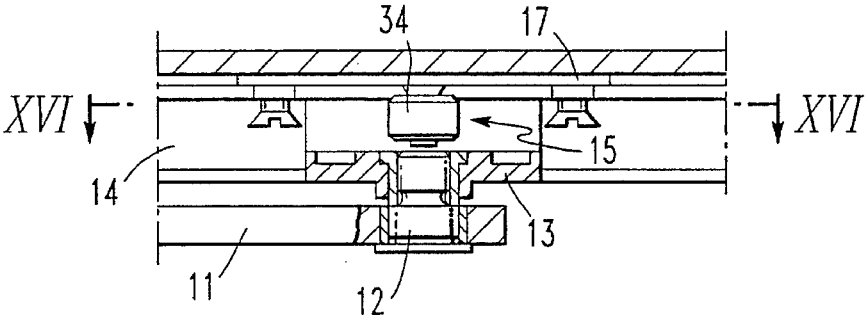
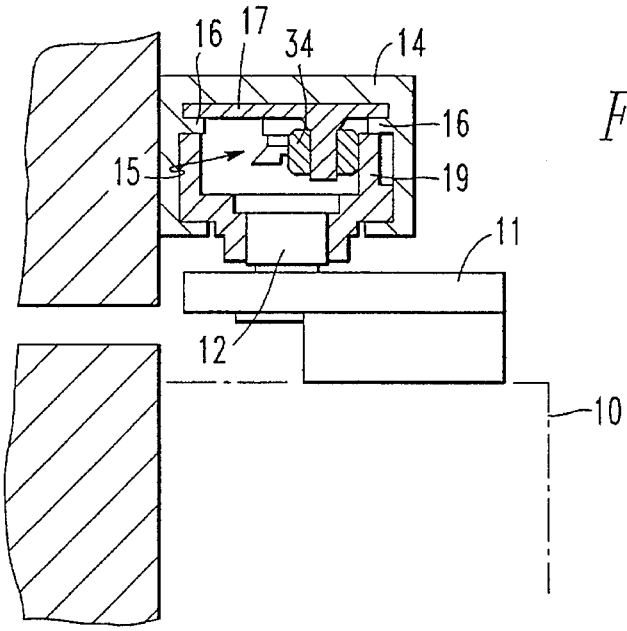
Fig. 15

DOOR CLOSER WITH A DETENT FOR HOLDING A DOOR OPEN AND THE DETENT THEREFOR

This is a divisional of U.S. Ser. No. 07/931,281, filed on Aug. 17, 1992, now U.S. Pat. No. 5,311,642 which claims priority from Federal Republic of Germany Patent Application No. P 40 05 203, filed on Feb. 20, 1990, and based on International Application No. PCT/DE 90/00962, filed on Dec. 13, 1990.

BACKGROUND OF THE INVENTION

1. Field of the Invention

This invention relates to a fixing device for door panels with a door closer, the closer shaft of which is coupled to one end of a swivel arm, the other end of which is engaged by means of a slide so that it can move longitudinally in a guide rail. The slide together with an abutment fastened to the guide rail forms a holding unit to fix the door panel connected to the swivel arm, whereby the holding unit comprises an overthrusting, automatically yielding and resetting holding element.

2. Background Information

On fixing devices of the prior art, a holding element in the form of a spring-loaded pivoting lever, the travel of which can be limited, is mounted on the abutment fastened to the guide rail. The pivoting lever has a retaining cam for a pin of the slide which may cross the holding element. For its part, the slide is mounted so that it can move longitudinally in the guide rail, and is connected to the free end of the swivelling arm of a door closer. On such fixing devices of the prior art, the swivelling lever forming the holding element is essentially located above the slide in the guide rail, and for this reason, and on account of the spring mounting or suspension of the swivelling lever and the limitation of the swivelling lever travel, the guide rail must be relatively tall. In addition to this uneconomical configuration of the guide rail, the fixing device itself is a relatively expensive part to manufacture.

OBJECT OF THE INVENTION

The object of this invention is to improve a fixing device of the type described above so that a compact construction is possible, using a few, simple components, and the fixing device being subjected to almost no wear.

SUMMARY OF THE INVENTION

This object is achieved by one embodiment of the invention, in that, the holding element has a spring-mounted leg with a leading bevel and a trailing bevel, which are interrupted by a notch or catch. It is thereby possible to reduce the number of components, and to locate the essential components of the fixing device inside the slide, which preferably has an essentially U-shaped cross section.

In one preferred embodiment of the invention, the abutment is designed as a flat piece fastened to the guide rail, which has two legs designed as essentially isosceles triangles, which are oriented with the tips of their legs forming the notch transverse to the longitudinal axis of the guide rail, enclosing between them an elastic buffer element which cushions the leg, and by means of which the catches on the leg, when the door is fixed, are held in notches on the inside surfaces of the side walls of the slide. In this manner, it is possible to form a compact abutment, on which the two legs opposite one another are guided transverse to the longitudinal direction of the guide rail, and project into the path of movement of the slide. The location of the leg, which can be displaced in relation to the buffer element, also makes it possible for the slide to travel over the abutment, although the slide is exactly positioned when the door is fixed.

The buffer element is preferably designed as a cylindrical disc, which is supported in recesses of each leg, which expand into a cylindrical hole. To achieve a hard elastic buffer element, the buffer element can have a central hole, in which is located a non-elastic pin which fills the hole. So that the action of the buffer element acts at the point on the legs where, when the door is fixed, they come in contact with the slide, the buffer element is preferably located exclusively in the area of action of the side walls of the slide acting on the leg when the door is fixed.

An additional embodiment of the invention according to the object of the invention can be achieved by forming the holding element by means of elastic legs forming side walls of the slide, which with their notches, when the door is fixed, surround a rhomboid or diamond-shaped projection of the flat piece abutment in certain areas. In an additional embodiment of the invention, the legs of the holding element, however, can also be designed as leaf springs fastened to both sides of the slide, and these springs, with their notches, can surround portions of a hard elastic circular disc mounted on the abutment.

An additional embodiment of the invention according to the object of the invention can be formed if the slide has an elastic leg only on one side, in whose notches, when the door is fixed, an angular leg projecting from the flat piece abutment is engaged.

The embodiment of the invention according to the invention described immediately above can be modified by having the slide have an elastic leg only on one side, in whose notches, when the door is fixed, a hard elastic roller mounted on the flat piece abutment is engaged. Other embodiments of the invention may be modified such that only one recess is used instead of two.

In summary, one aspect of the invention resides broadly in a door closer apparatus which is affixable to a door, the door closer apparatus comprising: a channel, affixable to a member of a door mounting frame which is perpendicular to a plane passing through the hinge axis of the door, with the channel for being disposed parallel to the longitudinal axis of the frame member; an arm extending from the door closer to the channel for closing a door, the arm having a first end and a second end, the door closer having detent apparatus for holding a door open, the detent apparatus being affixable to a door mounting frame and to a door hinged from the door mounting frame to pivot the door about an axis from a normally closed position to an open position, and for detenting the door at a selected open position. The detent apparatus comprises: a slide positioned inside the channel and slidable along the channel; the arm pivotally connected at the first end to the slide and operatively, pivotally connectable at the second end to the door at a point removed from the door hinge axis; a detent member having mutually orthogonal longitudinal and lateral axes, the detent member for being selectively positioned within the channel, the slide and the detent member comprising in combination detent means; the detent means comprising at least one surface having: a) a leading bevel portion and a trailing bevel portion, and b) a catch portion between the leading bevel portion and the trailing bevel portion, the catch portion joining the leading bevel portion and the trailing bevel portion with one another, the bevel portions each having a lower portion and a raised portion, the lower portions being disposed away from the catch portion and the raised portions being disposed against the catch portion, the detent means comprising means for urging at least one of the slide and the detent member in contact with the catch portion and into a detent relationship with one another, the slide and the detent member being configured so that the detent member extends into the path of the slide along the guide channel and being further configured so that the slide contacts the detent member as the slide moves within the channel and the detent member being yet further configured so that the slide makes contact with the detent member at a position corresponding to a desired detent position of the door, and the detent means being configured to be substantially resilient but having sufficient rigidity to generally prevent the slide from being pulled past the detent member in the absence of external forces applied to the door.

Another feature of the invention resides broadly in a door closer apparatus, wherein the detent bevel means portions are disposed on the slide.

A further feature of the invention resides broadly in a door closer apparatus, wherein the detent means bevel portions are disposed on the detent portion, the detent portion comprises an abutment, the abutment is configured to comprise a flat piece being fastened to the guide rail, the abutment comprises two legs configured to form an isosceles triangle configuration to form the bevel portions, the triangle configuration having a tip where the legs join, the tip forming at least a portion of the catch portion, the tip forming a line, the line oriented transverse to the longitudinal axis of the channel of the guide rail, and the urging means are configured for urging the abutment into contact with the slide to engage at least a portion of the catch portion with the slide.

A still further feature of the invention resides broadly in a door closer apparatus, wherein each of the legs have a tip, the urging means comprise an elastic buffer element supporting the legs, the slide also comprises, on each side thereof, a leading bevel portion and a trailing bevel portion, a notch, formed between each leading bevel portion and trailing bevel portion of the slide, to form at least a part of the catch portion, and the buffer element being disposed between the two legs for urging the tips of the legs into each the notch in the slide when the door is in the detent position, the buffer element comprises a cylindrical disc, the legs form a cylindrical hole portion for receiving the disc, the detent member has recesses the disc is supported against the recesses, the disc is configured for expanding into the cylindrical hole portion in the legs, the buffer element has a central hole, in which hole there is an inelastic pin which fills up the hole.

A yet further feature of the invention resides broadly in a door closer apparatus, wherein the slide comprises the means for urging, the bevels are formed by walls of the slide, the bevels comprise at least a portion of the urging means, the bevels are configured as elastic legs, the catch portion is formed as a notch between the bevel portions, and the detent member comprises a rhomboid projection for being disposed in the notch when the door is fixed.

A still yet further feature of the invention resides broadly in a door closer apparatus, wherein the slide comprises the means for urging, the bevels are formed by walls of the slide, the bevels comprise at least a portion of the urging means, the bevels are configured as elastic legs, the catch portion is formed as a notch between the bevel portions, and the detent member comprises a hard elastic circular disc for being disposed in the notch when the door is fixed.

Another further feature of the invention resides broadly in a door closer apparatus, wherein the slide comprises the means for urging, the bevels are formed by a wall on only one side of the slide, the bevels comprise at least a portion of the urging means, the bevels are configured as elastic legs, the catch portion is formed as a notch between the bevel portions, the detent member comprises an angular leg for being disposed in the notch when the door is fixed, and the detent member comprises a portion having at least one flat surface from which the angular leg projects.

Still another further feature of the invention resides broadly in a door closer apparatus, wherein the slide comprises the means for urging, the bevels are formed by a wall on only one side of the slide, the bevels comprise at least a portion of the urging means, the bevels are configured as elastic legs, the catch portion are formed as a notch between the bevel portions, and the detent member comprises a hard elastic circular disc for being disposed in the notch when the door is fixed.

Still another further feature of the invention resides broadly in an apparatus for holding a door open, the apparatus being affixable to a door mounting frame and to a door hinged from the door mounting frame to pivot the door about an axis from a normally closed position to an open position, and for detenting the door at a selected open position, the apparatus comprising: a guide rail comprising a channel; the channel, affixable to a member of a door mounting frame which is perpendicular to a plane passing through the hinge axis of the door; the channel having a longitudinal axis for being disposed parallel to the longitudinal axis of the frame member; the channel having a slot extending along a wall of the channel; a slide positioned inside the channel and slidable along the channel; an arm having a first end and a second end; the arm pivotally connected at the first end to the slide and operatively, pivotally connectable at the second end to the door at a point removed from the door hinge axis; a detent member having mutually orthogonal longitudinal and lateral axes; the detent member for being selectively positioned within the channel proximate the slotted wall of the channel within the channel; the slide and the detent member comprising in combination detent means; the detent means comprising at least one surface having a leading bevel portion and a trailing bevel portion and a catch portion between the leading bevel portion and the trailing bevel portion; the catch portion joining the leading bevel portion and the trailing bevel portion with one another; the bevel portions each having a lower portion and a raised portion; the lower portions being disposed away from the catch portion and the raised portions being disposed proximate the catch portion; the detent means comprising means for urging at least one of the slide and the detent member in contact with the catch portion and into a detent relationship with one another; the slide and the detent member being configured so that the detent member extends into the path of the slide along the guide channel and further configured so that the slide contacts the detent member as the slide moves within the channel and the detent member being yet further configured so that the slide makes contact with the detent member at a position corresponding to a desired detent position of the door; the detent means being configured to be substantially resilient but having sufficient rigidity to generally prevent the slide from being pulled past the detent member in the absence of external forces applied to the door.

Still another further feature of the invention resides broadly in an apparatus for holding a door open wherein the detent bevel means portions are disposed on the slide.

Still another further feature of the invention resides broadly in an apparatus for holding a door open wherein the detent bevel means portions are disposed on the detent portion.

Still another further feature of the invention resides broadly in an apparatus for holding a door open wherein the detent bevel means portions are also disposed on the detent portion.

Still another further feature of the invention resides broadly in an apparatus for holding a door open wherein the detent portion comprises an abutment, the abutment is configured to comprise a flat piece being fastened to the guide rail, the abutment comprises two legs configured to form an isosceles triangle configuration to form the bevel portions, the triangle configuration having a tip where the legs join; the tip forming at least a portion of the catch portion, the tip forming a line, the line oriented transverse to the longitudinal axis of the channel of the guide rail and the urging means configured for urging the abutment into contact with the slide to engage at least a portion of the catch portion with the slide.

Still another further feature of the invention resides broadly in an apparatus for holding a door open wherein each of the legs have a tip, the urging means comprise an elastic buffer element supporting the legs, the slide also comprising, on each side thereof, a leading bevel portion and a trailing bevel portion, a notch, formed between each leading bevel portion and trailing bevel portion of the slide, to form at least a part of the catch portion, the buffer element being disposed between the two legs for urging the tips of the legs into each notch in the slide when the door is in the detent position.

Still another further feature of the invention resides broadly in an apparatus for holding a door open wherein the buffer element comprises a cylindrical disc, the legs form a cylindrical hole portion for receiving the disc, the detent member has recesses the disc is supported against the recesses, the disc being configured for expanding into the cylindrical hole portion in the legs.

Still another further feature of the invention resides broadly in an apparatus for holding a door open wherein the buffer element has a central hole, in which hole there is an inelastic pin which fills up the hole.

Still another further feature of the invention resides broadly in an apparatus for holding a door open wherein the slide comprises the means for urging, the bevels are formed by walls of the slide, the bevels comprising at least a portion of the urging means, the bevels being configured as elastic legs, the catch portion formed as a notch between the bevel portions, the detent member comprising a rhomboid projection for being disposed in the notch when the door is fixed.

Still another further feature of the invention resides broadly in an apparatus for holding a door open wherein the slide comprises the means for urging, the bevels are formed by walls of the slide, the bevels comprising at least a portion of the urging means, the bevels being configured as elastic legs, the catch portion formed as a notch between the bevel portions, the detent member comprising a hard elastic circular disc for being disposed in the notch when the door is fixed.

Still another further feature of the invention resides broadly in an apparatus for holding a door open wherein the slide comprises the means for urging, the bevels are formed by a wall on only one side of the slide, the bevels comprising at least a portion of the urging means, the bevels being configured as elastic legs, the catch portion formed as a notch between the bevel portions, the detent member comprising an angular leg for being disposed in the notch when the door is fixed, and the detent member comprises a portion having at least one flat surface from which the angular leg projects.

Still another further feature of the invention resides broadly in an apparatus for holding a door open wherein the slide comprises the means for urging, the bevels are formed by a wall on only one side of the slide, the bevels comprising at least a portion of the urging means, the bevels being configured as elastic legs, the catch portion formed as a notch between the bevel portions, the detent member comprising a hard elastic circular disc for being disposed in the notch when the door is fixed.

BRIEF DESCRIPTION OF THE DRAWINGS

The invention is explained in greater detail below, with reference to the embodiments illustrated schematically in the accompanying drawings.

FIG. 10 shows the holding unit illustrated in FIG. 8 in a horizontal section along Line X—X in FIG. 8.

FIG. 11 shows an additional embodiment of the holding unit of a fixing device, in a vertical section as in FIGS. 2, 5 and 8.

FIG. 12 shows the holding unit illustrated in FIG. 11 in a cross section.

FIG. 13 shows the holding unit illustrated in FIG. 11, in a horizontal section along Line XIII—XIII in FIG. 11.

FIG. 14 shows the holding unit in an additional embodiment, in a vertical section as illustrated in FIGS. 2, 5, 8 and 11.

FIG. 15 shows the holding unit illustrated in FIG. 14, in cross section.

DESCRIPTION OF THE PREFERRED EMBODIMENTS

Figure 1:
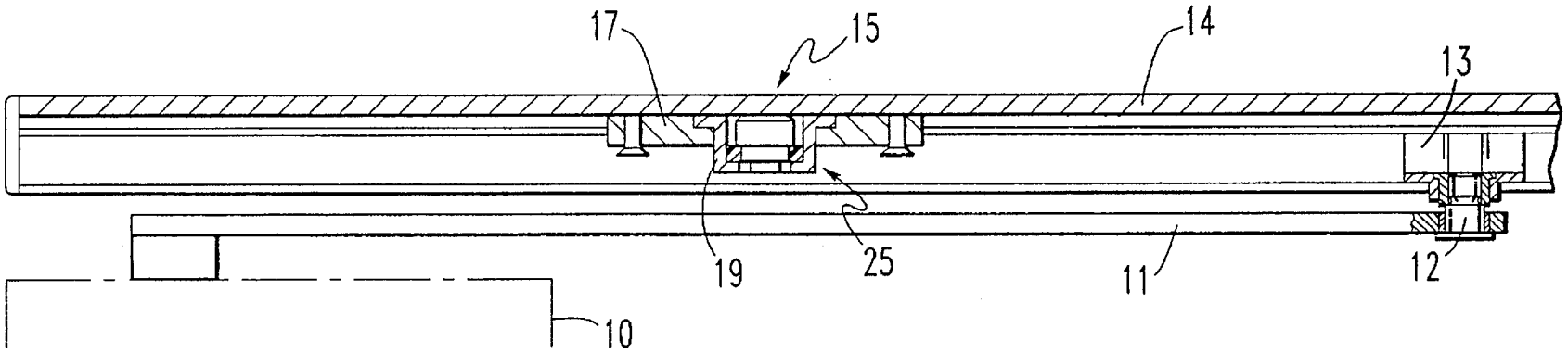
FIG. 1 shows the fixing device in a cross section view, with an abutment fastened to the guide rail, and a slide which can move longitudinally in the guide rail coupled to the free end of the swivelling in its movement position.

FIG. 1 shows a swivel arm 11, which is torsionally connected on one side to the swivelling shaft of a door closer 10 indicated in dashed lines and fastened, for example, to a door panel (not shown). The other end of this swivel arm 11 is mounted on a pin 12, which is preferably permanently connected to a slide 13, which in turn is located so that it can move longitudinally in a guide rail 14 fastened above the door panel. In the guide rail 14, in a position corresponding to the open position of the door panel, there is an abutment 15, fastened, e.g. by form-fitting, in the guide rail 14, which together with the slide 13 acts as a holding unit to fix the door panel in its open position.

The guide rail 14 preferably has a C-shaped cross section which is open on the bottom, and in its upper area has two strip-like projections 16 (See FIG. 2) opposite one another, which together with the upper wall of the guide rail 14, form a groove 16*a* to hold a flat piece 17 which can be braced inside it the groove 16*a*. The flat piece 17 can be selectively positioned within the groove 16*a*, and can be braced in a selected position by means of screws 17*a*.

Figure 1A:
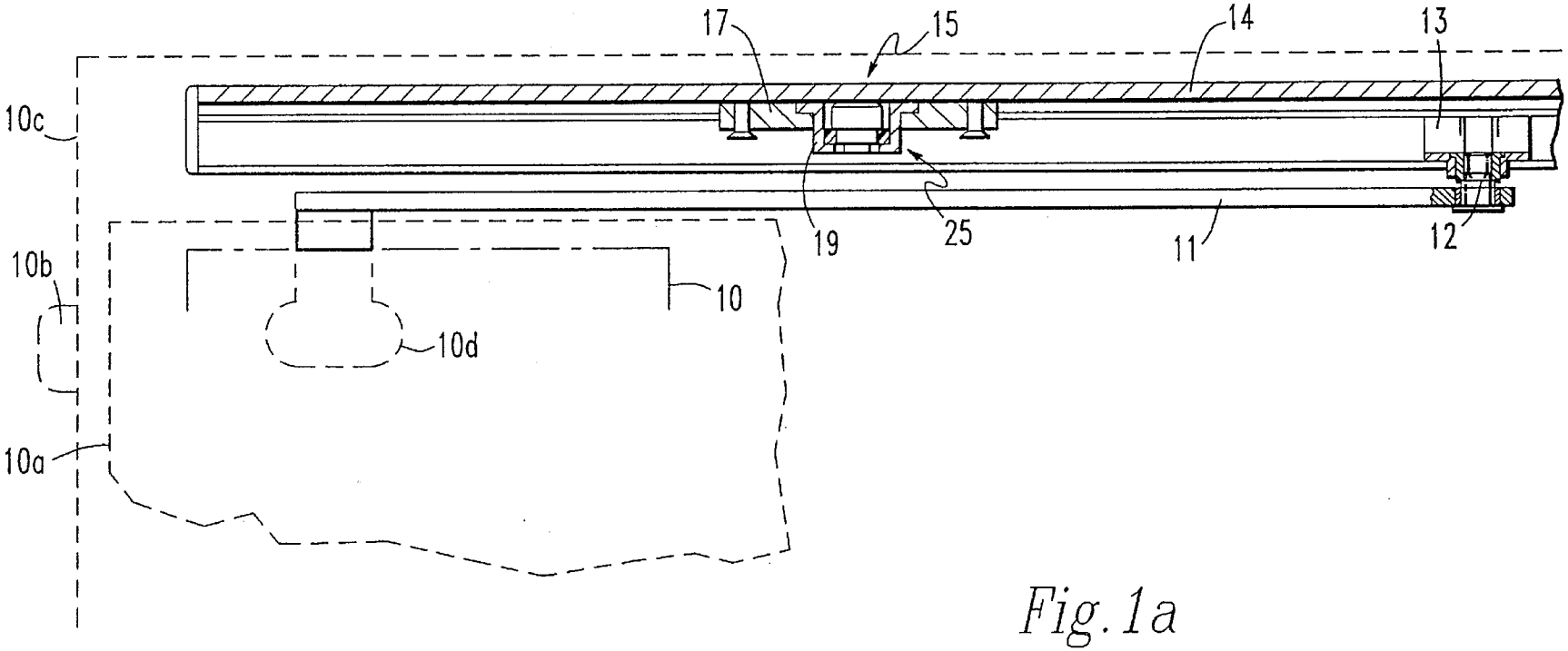
FIG. 1*a* shows the fixing device in a cross section view, with an abutment fastened to the guide rail, and a slide which can move longitudinally in the guide rail coupled to the free end of the swivelling arm, in its movement position.

FIG. 1*a* shows a swivel arm 11, which is torsionally connected on one side to the swivelling shaft of a door closer 10 indicated in dashed lines and fastened, for example, to a door panel 10*a*. The other end of this swivel arm 11 is mounted on a pin 12, which is preferably permanently connected to a slide 13, which in turn is located so that it can move longitudinally in a guide rail 14 fastened above the door panel. In the guide rail 14, in a position corresponding to the open position of the door panel, there is an abutment 15, fastened, e.g. by form-fitting, in the guide rail 14, which together with the slide 13 acts as a holding unit to fix the door panel in its open position.

Hinges 10*b* hold the door 10*a* in a door-jamb or frame 10*c*. The door closer 10 includes motor apparatus 10*d* preferably either hydraulic or pneumatic, for acting upon the swivel arm 11 for closing the door 10*a*.

Figure 2:
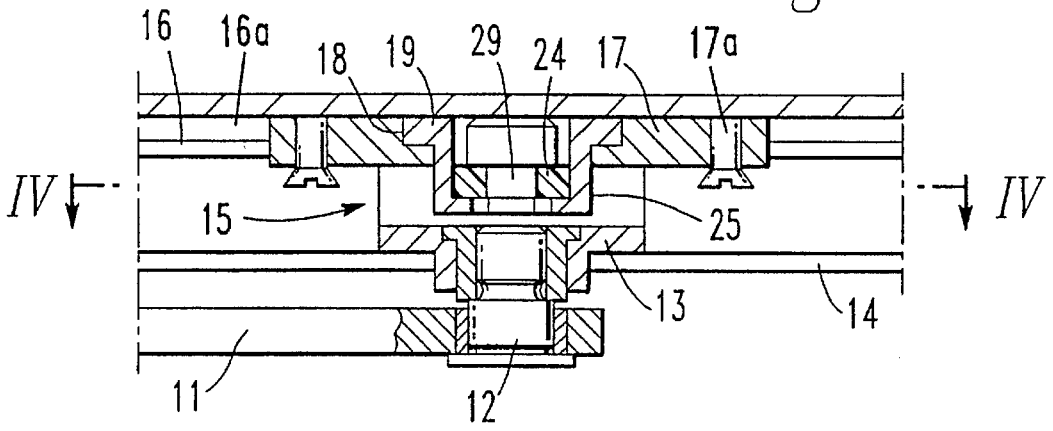
FIG. 2 shows the holding unit formed by the slide and abutment in the fixed position, in a longitudinal section analogous to FIG. 1.
Figure 3:
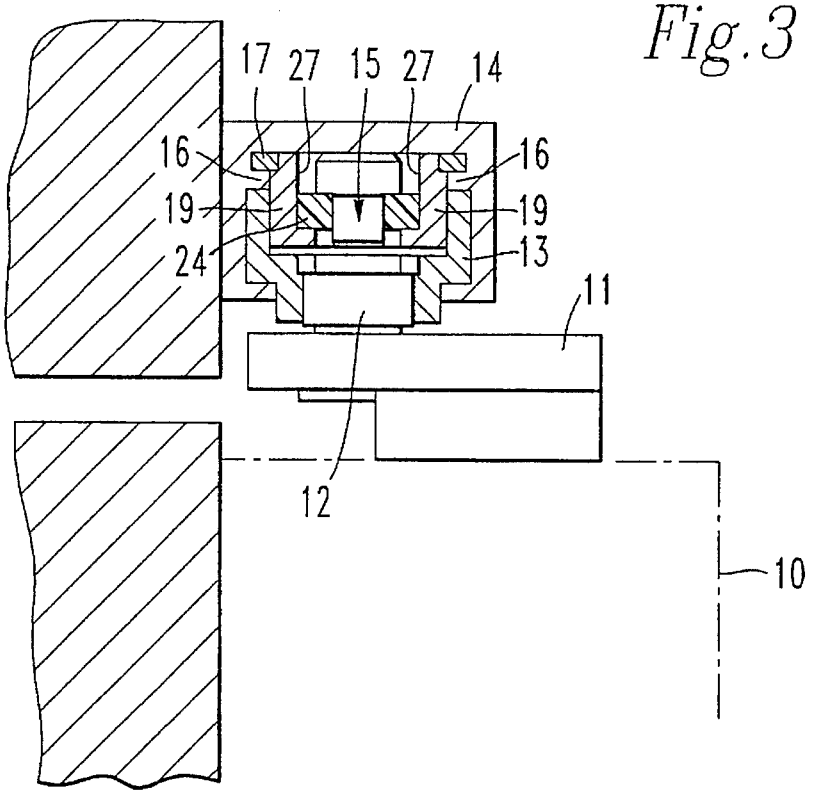
FIG. 3 shows the holding unit illustrated in FIG. 2, in cross section.
Figure 4:
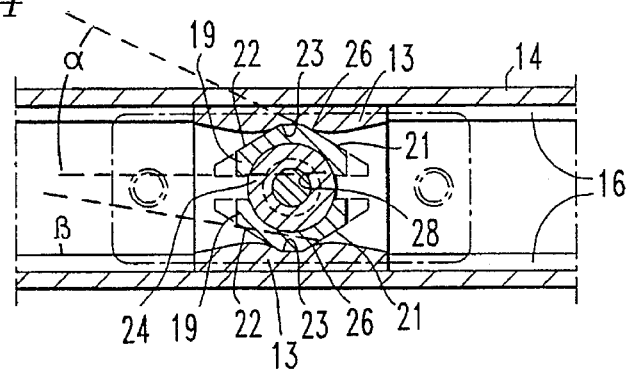
FIG. 4 shows the holding unit illustrated in FIG. 2, in a horizontal section along Line IV—IV in FIG. 2.

In the embodiment illustrated in FIGS. 2 to 4, the flat piece 17 has, on its reverse side, a guide recess 18, in which are located the feet of two legs 19 designed as isosceles triangles and located at some distance from one another. As a result of their shape, these legs 19 have a leading bevel 21 and a trailing bevel 22, which bevels 21 and 22 essentially define an angle (alpha) of about 30° with the longitudinal axis of the channel, and which in the area where they come into contact with one another, each may form a notch 23 or be engagable with a notch in the central region thereof. These legs 19, on their sides facing one another, each have a recess 27 preferably in the shape of a segment of a circle, which are filled by a buffer element 24 which provides elastic support for a leg 19. These two legs 19 which can be moved by the elastic buffer element 24 transverse to the longitudinal direction of the guide rail 14, along the length of the guide rail 14 may form a holding element 25 for the slide 13, which preferably has a U-shaped cross section. The projecting legs, which are in contact with the side walls of the guide rails, have, on the inside, a notch 26 which fits the catch 23 of the leg 19. In the direction of movement, the legs of the slide 13 are also designed so that they ascend at an angle (beta) of about 10° with respect to the longitudinal axis from their outsides to the central notch 26, namely so that at the beginning of the encounter between the slide 13 and the leg 19, there is a small clearance. When the slide 13 slides on the legs 19, the latter are pressed together against the action of the biasing or buffer element 24, until they are finally able to engage in the notch 26 in the legs of the slide 13. The buffer element 24 preferably has a central hole 28, in which is engaged an inelastic pin which fills it up, with a positive and form fit, to increase the return force of the buffer element 24.

Figure 5:
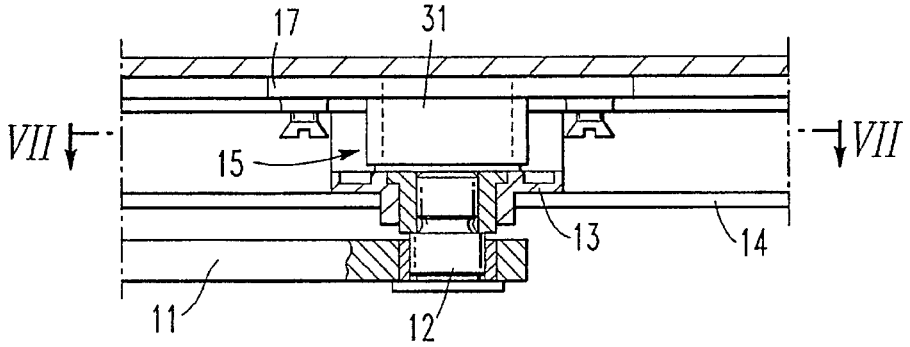
FIG. 5 shows an additional embodiment of the holding unit as in FIG. 2, in a vertical section.
Figure 6:
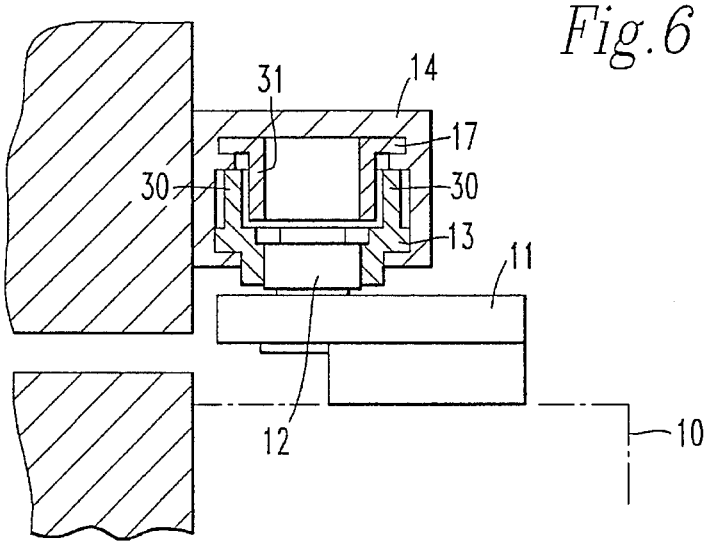
FIG. 6 shows the holding unit illustrated in FIG. 5, in cross section.
Figure 7:
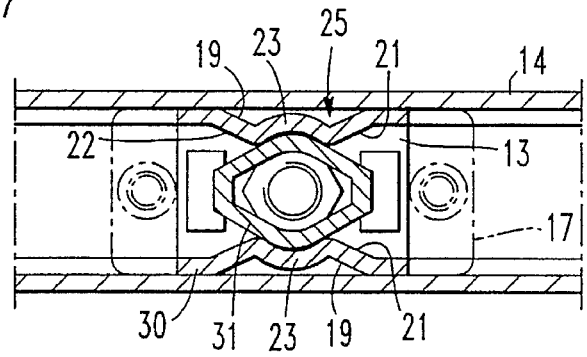
FIG. 7 shows the holding unit illustrated in FIG. 5 in a horizontal section along Line VII—VII in FIG. 5.

In the embodiment illustrated in FIGS. 5 to 7, an abutment 15 is also fastened in the guide rail 14, and together with the slide 13 forms a holding unit. This slide 13, also, is connected by means of a pin 12 fastened to it with the swivelling arm 11 of a door closer 10. In this embodiment, however, the side walls 30 located on both longitudinal sides of the slide 13 act as the holding element 25. These two side walls 30 have leading bevels 21 and trailing bevels 22 designed as elastic legs 21. Between each leading bevel 21 and the trailing bevel 22, a form-fitting catch 23 is formed. When the door is fixed, as illustrated in FIGS. 5 to 7, these catches 23 on the legs 19 of the slide 13 interact with a rhomboid or diamond-shaped projection 31 of the flat piece 17 which functions as the abutment 15.

Figure 8:
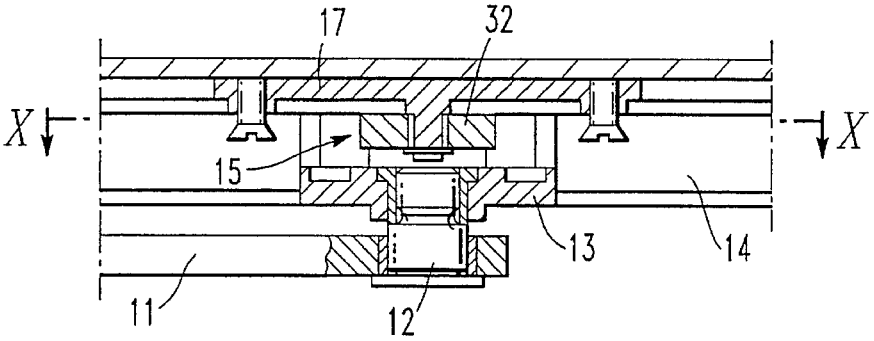
FIG. 8 shows an additional embodiment of a holding unit in a vertical section, as shown in FIGS. 2 and 5.
Figure 9:
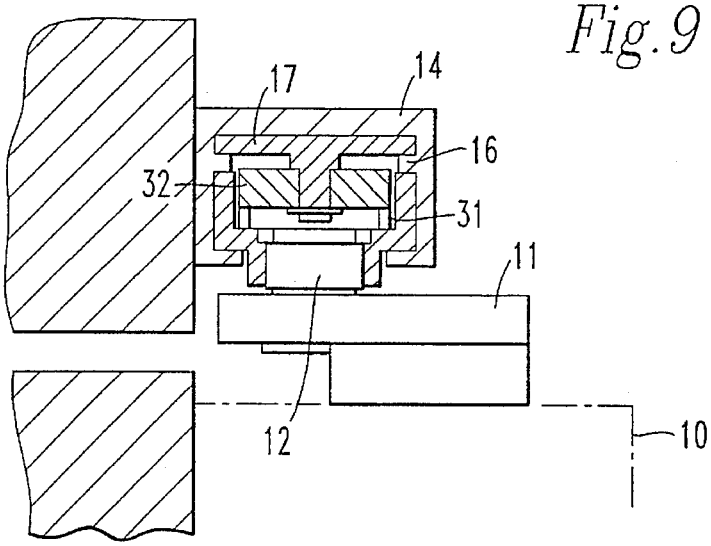
FIG. 9 shows the holding unit illustrated in FIG. 8, in a cross section.

The embodiment illustrated in FIGS. 8 to 10 is generally somewhat similar in the principle of operation as the embodiment described above and illustrated in FIGS. 5 to 7. One difference, however, is that the holding element 25 does not consist of legs formed in one piece on the slide 13, but the legs 19 forming the holding element 25 are designed as independent leaf springs 31 mounted on the sidewalls of the slide 13. Each leaf spring 31 in turn has a recoiling catch 23 designed as a recess which, when the door is fixed, positively encloses portions of a hard elastic circular disc 32 forming a abutment 15, and securely holds it in this position.

The embodiment disclosed in FIGS. 11 to 13 differs from the embodiment illustrated in FIGS. 5 to 7 in that there is a one-piece side wall formed into a leg 19 only on one side of the slide 13. This elastic leg 19 in turn has a leading bevel 21 and a trailing bevel 22, between which, in turn, the catch 23 is formed by an molded groove, in which, when the door is fixed, an angular leg 33 projecting from the flat piece abutment 15 is engaged. The angular leg 33 is shaped so that its legs slide along, depending on the direction of movement, either on the leading bevel 21 or on the trailing bevel 22, and that the tip of the angle between its legs is engaged in the notch 33 when the door is fixed. This situation is illustrated in particular in FIG. 13.

Figure 16:
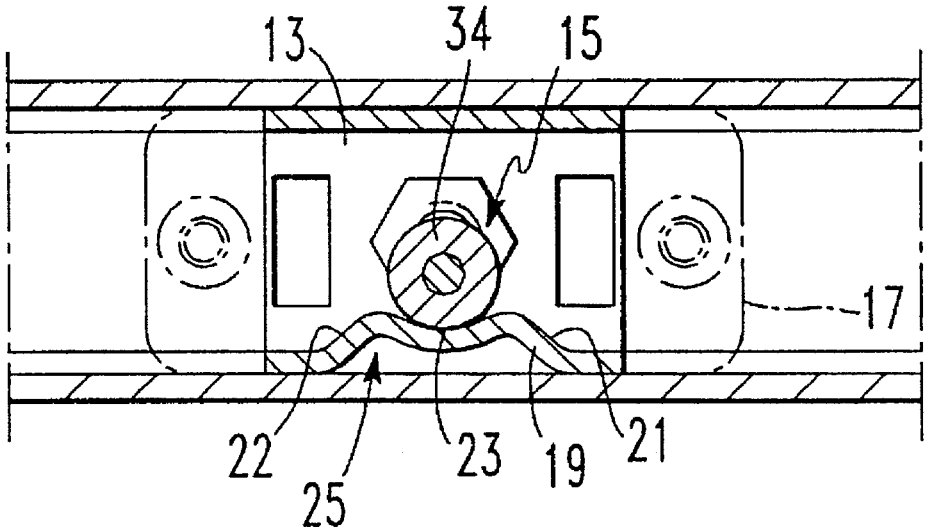
FIG. 16 shows the holding unit illustrated in FIG. 14, in a horizontal section along Line XVI—XVI in FIG. 14.

The embodiment illustrated in FIGS. 14 to 16 is essentially similar in its principal of operation as the embodiment illustrated in FIGS. 11 to 13. Hereagain, there is only a single elastic leg 19 on one of the two side walls of the slide 13, where the design and configuration of the leg are essentially the same as the leg 19 illustrated in FIG. 13. This leg also has a leading bevel 21 and a trailing bevel 22, between which, once again, the catch 23 is located in the form of a recess. 0n this holding element 25 corresponding to the slide 13, when the door is fixed, a hard elastic roller 34 forming an abutment 15 is engaged, when the slide 13 moves into the holding position illustrated in FIGS. 14 to 16. This roller 34 is mounted on an adjustable pin which is permanently connected to a flat piece 17 fixed in the rail 14 and offset in relation to the longitudinal center of the slide.

One feature of the invention resides broadly in a fixing device for door panels with a door closer, the closer shaft of which is coupled to one end of a swivel arm, the other end of which is engaged by means of a slide so that it can move longitudinally in a guide rail, and the slide together with an abutment fastened to the guide rail forms a holding unit to fix the door panel connected to the swivel arm, whereby the holding unit comprises an overthrusting, automatically yielding and resetting holding element, characterized by the fact that the holding element 25 has spring mounted legs 19 with a leading bevel 21 and a trailing bevel 22, which run together in a catch 23, and are engaged in a slide 13.

Another feature of the invention resides broadly in a fixing device, characterized by the fact that the abutment 15 is designed as a flat piece 17 fastened to the guide rail 14, which flat piece supports two legs 19 designed as isosceles triangles, which with the tips of their legs forming the catch 23 are oriented transverse to the longitudinal axis of the guide rail, and between which they hold an elastic buffer element 24 supporting the legs 19, by means of which buffer element 24, when the door is fixed, the notches 23 of the leg are held inside or between the leading bevel 21 and the trailing bevel 22 in notches 26 on the inside surface of the side walls of the slide 13.

Another feature of the invention resides broadly in a fixing device, characterized by the fact that the buffer element 24 is designed as a cylindrical disc, which is supported against recesses 27 which expand into a cylindrical hole in each leg 19.

Yet another feature of the invention resides broadly in a fixing device, characterized by the fact that the buffer element 24 has a central hole 28, in which there is an inelastic pin 29 which fills up said hole.

Still another feature of the invention resides broadly in a fixing device, characterized by the fact that the buffer element 24 is located exclusively in the area of action of the side walls of the slide 13 acting on the legs 19, when the door is fixed.

Another feature of the invention resides broadly in a fixing device, characterized by the fact that the holding element 25 is formed by side walls 30 of the slide 13 which form elastic legs 19, which with their notches 23, when the door is fixed, partly surround a rhomboid projection 31 of the flat piece abutment 15.

Yet another feature of the invention resides broadly in a fixing device, characterized by the fact that the legs 19 of the holding element 25 are formed out of the leaf springs 31 fastened on both sides of the slide 13, and these leaf springs 31, with their catches 23, surround portions of a hard elastic circular disc 32 mounted on the abutment 15.

Still another feature of the invention resides broadly in a fixing device, characterized by the fact that the slide 13 has an elastic leg 19 only on one side, in whose notch 23 an angular leg 33 projecting from the flat piece abutment 15 is engaged, when the door is fixed.

Another feature of the invention resides broadly in a fixing device, characterized by the fact that the slide 13 has an elastic leg 19 on only one side, in whose notch 23 a hard elastic roller 34 mounted on the flat piece abutment 15 is engaged, when the door is fixed.

All, or substantially all, of the components and methods of the various embodiments may be used in any combination with at least one embodiment or all of the embodiments described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Detent apparatus for holding a door in a selected open position relative to a door mounting frame, the door having a hinge axis for pivoting of the door thereabout, said detent apparatus comprising:

a guide rail affixable to a member of the door mounting frame which is perpendicular to a plane passing through a hinge axis of a door, the guide rail having a longitudinal dimension for being disposed parallel to a longitudinal axis of the frame member;

a guide element for being guided along said guide rail along a path of movement along the longitudinal dimension of said guide rail;

said guide rail and said guide element each being configured for permitting substantially unobstructed movement of said guide element along a substantial portion of said guide rail;

an arm having a first end and a second end, said first end of said arm comprising means for being pivotably connected to said guide element, and said second end of said arm comprising means for being pivotably connected to a door at a point spaced apart from a hinge axis of the door;

a detent member for being disposed along said guide rail, said detent member being movable along said guide rail, and said detent member being selectively positionable at at least two separate positions disposed a substantial distance from one another along said guide rail;

said detent member comprising means for retaining said detent member in a selected one of the at least two separate positions along said guide rail, said selected position of said detent member determining said selected open position of the door;

said guide element and said detent member comprising, in combination, detent means, said detent means comprising first and second detent means portions:

said first detent means portion comprising a catch portion disposed on one of said guide element and said detent member, and said second detent means portion comprising a corresponding projection on at least the other of said guide element and said detent member for being retained by said catch portion;

said detent means comprising means for urging at least one of said catch portion and said corresponding projection into a detent relationship with one another;

said detent member comprising means for disposing said detent means portion of said detent member in the path of said guide element for engaging said detent means portion of said guide element with said detent means portion of said detent member as said guide element moves along the guide rail; and said means for urging being substantially resilient for permitting engagement of said catch portion and said corresponding projection, and said means for urging having sufficient rigidity for maintaining engagement of said catch portion and said corresponding projection in the absence of external forces applied to the door.

2. The detent apparatus according to claim 1, further comprising:

said guide rail comprising a substantially C-shaped channel, said channel comprising:

a base portion; and first and second leg portions extending from said base portion, said first and second leg portions defining a first distance therebetween;

said guide element being configured for being disposed between said first and second leg portions of said channel, said guide element comprising:

a base portion for being disposed in a spaced apart relationship to said base portion of said channel; and at least a third leg portion extending from said base portion, said at least a third leg portion of said guide element being configured for being disposed adjacent one of said first and second leg portions of said channel for guiding movement of said guide member within said channel;

said detent member for being disposed within said channel between said first and second leg portions of said channel; and said at least a third leg portion of said guide element being configured to pass between said detent member and said adjacent one of said first and second leg portion of said channel during movement of said guide element along said path of travel for engagement of said first and second detent means portions with one another.

3. The detent apparatus according to claim 2, wherein:

said at least a third leg portion of said guide element comprises a first surface for being disposed adjacent said adjacent one of said first and second leg portions of said channel, and a second surface disposed opposite said first surface; and said second surface of said at least a third leg portion of said guide element comprises said detent means portion of said guide element.

4. The detent apparatus according to claim 3, wherein:

said guide element has a longitudinal dimension for being disposed along the longitudinal dimension of said channel;

said second surface of said at least a third leg portion comprises:

a first end and a second end, said first and second ends being disposed spaced apart along the longitudinal dimension of said guide element;

a central portion disposed between said first and second ends;

a first bevelled portion extending from said first end to substantially said central portion, said first bevelled portion having a lower portion adjacent said first end and a raised portion adjacent said central portion;

a second bevelled portion extending from said second end to substantially said central portion, said second bevelled portion having a lower portion adjacent said second end and a raised portion adjacent said central portion; and said catch portion disposed at said central portion, said catch portion comprising a recessed portion between said raised portions of both of said first and second bevelled portions; and said detent member comprises said corresponding projection for engaging with said catch portion of said guide element as said at least a third leg portion of said guide element passes between said detent member and said adjacent one of said first and second leg portions.

5. The detent apparatus according to claim 4, wherein:

said detent member comprises a base plate, said base plate having a width substantially equal to the first distance between said first and second leg portions of said channel, and said base plate having a thickness;

each of said first and second leg portions of said channel comprise strip projections disposed along the longitudinal dimension of said channel, and projecting away from a corresponding one of each of said first and second leg portions towards the other of said first and second leg portions;

said strip projections being disposed a second distance from said base portion of said channel;

said second distance being substantially equal to the thickness of said base plate; and said base plate of said detent member being slidable along said longitudinal dimension of said channel between said base portion of said channel and said strip projections of said first and second leg portions to adjustably position said detent member within said channel.

6. The detent apparatus according to claim 5, wherein:

said detent member comprises a portion extending from said base plate, said extending portion comprises a surface disposed towards said one of said first and second leg portions of said channel adjacent said third leg portion of said guide element;

said surface of said detent member comprises one of:

an arcuate surface and an angled surface; and said one of:

said arcuate surface and said angled surface comprise said corresponding projection of said detent member for engaging with said catch of said second surface of said guide element.

7. The detent apparatus according to claim 6, wherein:

said guide element comprises a substantially U-shaped guide element having a fourth leg portion disposed opposite to said third leg portion, said fourth leg portion of said guide element for being disposed adjacent the other of said first and second leg portions of said channel away from said third leg portion of said guide element;

said fourth leg portion of said guide element comprises a third surface for being disposed adjacent said adjacent one of the other of said first and second leg portions of said channel, and a fourth surface disposed opposite said third surface; and said fourth surface of said second leg portion comprises:

a third end and a fourth end, said third and fourth ends being disposed spaced apart along the longitudinal dimension of said guide element;

a central portion disposed between said third and fourth ends;

a third bevelled portion extending from said third end to substantially said central portion, said third bevelled portion having a lower portion adjacent said third end and a raised portion adjacent said central portion;

a fourth bevelled portion extending from said fourth end to substantially said central portion, said fourth bevelled portion having a lower portion adjacent said fourth end and a raised portion adjacent said central portion; and said central portion of said fourth leg portion of said guide element comprises an additional catch portion disposed opposite to said catch portion of said third leg portion of said guide element, said additional catch portion comprising a recessed portion between said raised portions of both of said third and fourth bevelled portions; and said detent member further comprises a second projection corresponding to said additional catch portion of said fourth leg portion, said second projection being disposed opposite to said first projection, and said first and second projections being configured to simultaneously engage said catch portions of said guide element.

8. The detent apparatus according to claim 7, wherein:

said first and second projections of said detent member comprise two legs extending from said base portion, each of said two legs comprising an isosceles triangle configuration, each of said isosceles triangle configurations comprising two substantially equal side portions joined together to define a tip, said two side portions and said tip defining one of said angled surfaces, said tip comprising said projection for engaging said catch portion; said tip forming a line, said line being oriented transverse to the longitudinal axis of said channel; and said urging means being disposed between said two leg portions for urging said leg portions away from one another and into contact with said catch portions of said guide element to engage the tip of said first and second leg portions with said catch portions of said guide element.

9. The detent apparatus according to claim 8, wherein:

said urging means comprises an elastic cylindrical disc supporting said legs;

said legs form a cylindrical hole portion for receiving said disc, said detent member has recesses, and said disc is supported against said recesses, said disc being configured for expanding into said cylindrical hole portion in said legs;

said cylindrical disc has a central hole, in which hole there is an inelastic pin which fills up said hole;

said two side portions of said isosceles triangle are disposed at an angle of about 30° with respect to the longitudinal axis of said channel;

said first, second, third and fourth bevelled portions of said guide element are disposed at an angle of about 10° with respect to the longitudinal axis of said channel; and said means for retaining comprises:

threaded orifices in said base plate of said detent member; and screws for being threaded into said orifices to wedge said base plate against said strip projections as said screws are threaded into said orifices and contact said base portion of said channel.

10. The detent apparatus according to claim 7, wherein:

said guide element comprises said means for urging;

said first, second, third and fourth bevelled portions of said third and fourth leg portions comprise at least a portion of said urging means;

said bevelled portions comprise elastic legs; and said detent member comprises a rhomboid projection for being disposed in said catch portions when the door is fixed, said rhomboid projection comprising a rhomboid wall extending from said base plate.

11. The detent apparatus according to claim 7, wherein:

said guide element comprises said means for urging;

said first, second, third and fourth bevelled portions of said third and fourth leg portions comprise at least a portion of said urging means;

said bevelled portions comprise elastic legs; and said detent member comprises a cylindrical projection extending from said base plate with a hard elastic circular disc disposed about said cylindrical projection, said disc comprising an edge portion thereof for being disposed in said catch portions when the door is fixed.

12. The detent apparatus according to claim 7, wherein:

said guide element comprises said means for urging;

said first, second, third and fourth bevelled portions of said third and fourth leg portions comprise at least a portion of said urging means;

said bevelled portions comprise elastic legs; and said detent member comprises an angular leg for being disposed in said catch portions when the door is fixed; and said angular leg extending from said base plate of said detent member.

13. A door, said door comprising:

a frame member;

a door panel, the door panel having a hinge axis for pivoting of the door thereabout to open and close the door;

door closer apparatus mounted to said door panel for moving the door from an open position to a closed position;

a detent apparatus for holding the door in a selected open position relative to the frame member and against the closing force of the door closer apparatus, said detent apparatus comprising:

a guide rail affixed to a portion of the door mounting frame which is perpendicular to a plane passing through the hinge axis of the door, the guide rail having a longitudinal dimension for being disposed parallel to a longitudinal axis of the frame portion;

a guide element for being guided along said guide rail along a path of movement along the longitudinal dimension of said guide rail;

said guide rail and said guide element each being configured for permitting substantially unobstructed movement of said guide element along a substantial portion of said guide rail;

an arm having a first end and a second end, said first end of said arm comprising means for pivotably connecting said first end to said guide element, and said second end of said arm comprising means for pivotably connecting said second end to said door closer apparatus at a point spaced apart from the hinge axis of the door;

a detent member for being disposed along said guide rail, said detent member being movable along said guide rail, and said detent member being selectively positionable at at least two separate positions disposed a substantial distance from one another along said guide rail;

said detent member comprising means for retaining said detent member in a selected one of the at least two separate positions along said guide rail, said selected position of said detent member determining said selected open position of the door;

said guide element and said detent member comprising, in combination, detent means, said detent means comprising first and second detent means portions:

said first detent means portion comprising a catch portion disposed on one of said guide element and said detent member, and said second detent means portion comprising a corresponding projection on at least the other of said guide element and said detent member for being retained by said catch portion;

said detent means comprising means for urging at least one of said catch portion and said corresponding projection into a detent relationship with one another;

said detent member comprising means for disposing said detent means portion of said detent member in the path of said guide element for engaging said detent means portion of said guide element with said detent means portion of said detent member as said guide element moves along the guide rail; and said means for urging being substantially resilient for permitting engagement of said catch portion and said corresponding projection, and said means for urging having sufficient rigidity for maintaining engagement of said catch portion and said corresponding projection under the closing force of the door closer and in the absence of additional external forces applied to the door.

14. The door according to claim 13, further comprising:

said guide rail comprising a substantially C-shaped channel, said channel comprising:

a base portion; and first and second leg portions extending from said base portion, said first and second leg portions defining a first distance therebetween;

said guide element being configured for being disposed between said first and second leg portions of said channel, said guide element comprising:

a base portion for being disposed in a spaced apart relationship to said base portion of said channel; and at least a third leg portion extending from said base portion, said at least a third leg portion of said guide element being configured for being disposed adjacent one of said first and second leg portions of said channel for guiding movement of said guide member within said channel;

said detent member for being disposed within said channel between said first and second leg portions of said channel; and said at least a third leg portion of said guide element being configured to pass between said detent member and said adjacent one of said first and second leg portion of said channel during movement of said guide element along said path of travel for engagement of said first and second detent means portions with one another.

15. The door according to claim 14, wherein:

said at least a third leg portion of said guide element comprises a first surface for being disposed adjacent said adjacent one of said first and second leg portions of said channel, and a second surface disposed opposite said first surface;

said guide element has a longitudinal dimension for being disposed along the longitudinal dimension of said channel;

said second surface of said at least a third leg portion comprises:

a first end and a second end, said first and second ends being disposed spaced apart along the longitudinal dimension of said guide element;

a central portion disposed between said first and second ends;

a first bevelled portion extending from said first end to substantially said central portion, said first bevelled portion having a lower portion adjacent said first end and a raised portion adjacent said central portion;

a second bevelled portion extending from said second end to substantially said central portion, said second bevelled portion having a lower portion adjacent said second end and a raised portion adjacent said central portion; and said catch portion disposed at said central portion, said catch portion comprising a recessed portion between said raised portions of both of said first and second bevelled portions; and said detent member comprises said corresponding projection for engaging with said catch portion of said guide element as said at least a third leg portion of said guide element passes between said detent member and said adjacent one of said first and second leg portions.

16. The door according to claim 15, wherein:

said detent member comprises a base plate, said base plate having a width substantially equal to the first distance between said first and second leg portions of said channel, and said base plate having a thickness;

each of said first and second leg portions of said channel comprise strip projections disposed along the longitudinal dimension of said channel, and projecting away from a corresponding one of each of said first and second side portions towards the other of said first and second side portions;

said strip projections being disposed a second distance from said base portion of said channel;

said second distance being substantially equal to the thickness of said base plate; and said base plate of said detent member being slidable along said longitudinal dimension of said channel between said base portion of said channel and said strip projections of said first and second side portions to adjustably position said detent member within said channel.

17. The door according to claim 16, wherein:

said guide element comprises a substantially U-shaped guide element having a fourth leg portion disposed opposite to said third leg portion, said fourth leg portion of said guide element for being disposed adjacent the other of said first and second leg portions of said channel;

said fourth leg portion of said guide element comprises a third surface for being disposed adjacent said adjacent one of the other of said first and second leg portions of said channel, and a fourth surface disposed opposite said third surface; and said fourth surface of said second leg portion comprises:

a third end and a fourth end, said third and fourth ends being disposed spaced apart along the longitudinal dimension of said guide element;

a central portion disposed between said third and fourth ends;

a third bevelled portion extending from said third end to substantially said central portion, said third bevelled portion having a lower portion adjacent said third end and a raised portion adjacent said central portion;

a fourth bevelled portion extending from said fourth end to substantially said central portion, said fourth bevelled portion having a lower portion adjacent said fourth end and a raised portion adjacent said central portion; and said central portion of said fourth leg portion of said guide element comprises an additional catch portion disposed opposite to said catch portion of said third leg portion of said guide element, said additional catch portion comprising a recessed portion between said raised portions of both of said third and fourth bevelled portions; and said detent member comprises a portion extending from said base plate, said extending portion comprising a first surface disposed towards said first leg portion and a second surface opposite to said first surface and disposed towards said second leg portion;

said first and second surface of said detent member comprise ones of:

arcuate surfaces and angled surfaces; and said ones of:

said arcuate surfaces and said angled surfaces comprise corresponding first and second projections of said detent member for simultaneously engaging with said catch portions of said guide element.

18. A guide assembly for controlling opening and closing of a door, the door having a hinge axis for pivoting of the door thereabout, said guide assembly comprising:

a channel affixable to a member of the door mounting frame which is perpendicular to a plane passing through a hinge axis of a door, the channel having a longitudinal dimension for being disposed parallel to a longitudinal axis of the frame member; and the channel comprising:

a base portion;

first and second leg portions extending from said base portion, said first and second leg portions being disposed spaced apart a first distance from one another;

a single slide for being guided within said channel along a path of movement along the longitudinal dimension of said channel, said slide having a longitudinal dimension for being disposed along the longitudinal dimension of said channel;

said slide comprising a base portion with at least a third leg portion extending from said base portion, said slide for being disposed in said channel with said third leg portion disposed in contact with one of said first and second leg portions of said channel;

said third leg portion having a first surface for being disposed in contact with said one of said first and second leg portions and a second surface opposite to said first surface, said second surface comprising:

a first end and a second end with a first recessed catch portion disposed between the first and second ends;

first and second bevelled portions leading to said first recessed catch portion said first and second bevelled portions each having a lower portion and a raised portion with said lower portion being disposed away from said first catch portion and said raised portion being disposed adjacent said first catch portion;

an arm having a first end and a second end said first end of said arm comprising means for being pivotably connected to said slide, and said second end of said arm comprising means for being pivotably connected to a door at a point spaced apart from a hinge axis of the door;

detent means for holding a door in a selected open position relative to a door mounting frame said detent means comprising:

a detent member for being disposed between said first and second leg portions of said channel at a position along said channel, said position of said detent member determining said selected open position of the door;

said detent member having a first surface disposed towards said one of said first and second leg portions of said channel, and said first surface comprising:

a first corresponding projection for engaging said first recessed catch portion of said slide; and means for disposing said first projection in the path of said slide for engagement of said first catch portion of said slide with said first projection of said detent member as said third leg portion of said slide moves between said detent member and said one of said first and second leg portions of said channel;

at least one of said slide and said detent member comprising means for urging at least one of said first catch portion and said first projection into a detent relationship with one another;

said means for urging being substantially resilient for permitting engagement of at least said first catch portion and said first corresponding projection and said means for urging having sufficient rigidity for maintaining engagement of said first catch portion and said first corresponding projection in the absence of external forces applied to the door;

said channel and said slide each being configured for permitting substantially unobstructed movement of said slide along a substantial portion of said channel;

said channel comprises a substantially C-shaped channel;

said detent member comprises a base plate, said base plate having a width substantially equal to the first distance between said first and second leg portions of said channel, and said base plate having a thickness;

each of said first and second leg portions of said channel comprise strip projections disposed along the longitudinal dimension of said channel, and projecting away from a corresponding one of each of said first and second side portions towards the other of said first and second side portions;

said strip projections being disposed a second distance from said base portion of said channel;

said second distance being substantially equal to the thickness of said base plate;

said base plate of said detent member being slidably positionable along said longitudinal dimension of said channel between said base portion of said channel and said strip projections of said first and second side portions to adjustably position said detent member to positions within said channel;

said slide comprises a substantially U-shaped slide having a fourth leg portion disposed opposite to said third leg portion, said fourth leg portion of said slide for being disposed adjacent to and in contact with the other of said first and second leg portions of said channel;

said fourth leg portion of said slide comprises a third surface for being disposed adjacent said adjacent one of the other of said first and second leg portions of said channel, and a fourth surface disposed opposite said third surface;

said fourth surface of said second leg portion comprises:

a third end and a fourth end, said third and fourth ends being disposed spaced apart along the longitudinal dimension of said slide;

a central portion disposed between said third and fourth ends;

a third bevelled portion extending from said third end to substantially said central portion, said third bevelled portion having a lower portion adjacent said third end and a raised portion adjacent said central portion;

a fourth bevelled portion extending from said fourth end to substantially said central portion, said fourth bevelled portion having a lower portion adjacent said fourth end and a raised portion adjacent said central portion; and said central portion of said fourth leg portion of said slide comprises an additional catch portion disposed opposite to said catch portion of said third leg portion of said slide, said additional catch portion comprising a recessed portion between said raised portions of both of said third and fourth bevelled portions; and said detent member further comprises a second projection corresponding to said additional catch portion of said fourth leg portion, said second projection being disposed opposite to said first projection, and said first and second projections being configured to simultaneously engage said catch portions of said slide.

19. The assembly according to claim 18, wherein:

said detent member comprises a portion extending from said base plate, said extending portion comprises said surface disposed towards said one of said first and second leg portions of said channel, said extending portion comprises an additional surface disposed towards the other of said first and second leg portions, said surfaces of said detent member comprise one of: arcuate surfaces and angled surfaces; and said one of: said arcuate surfaces and said angled surfaces comprise said corresponding first and second projections of said detent member for engaging with said catches of said slide;

said first, second, third and fourth bevelled portions of said slide are disposed at an angle of about 10° with respect to the longitudinal axis of said channel;

said angled surfaces of said detent member are disposed at an angle of about 30° with respect to the longitudinal axis of said channel; and said detent member comprises means for retaining said detent member in a selected position within said channel, said means for retaining comprising:

threaded orifices in said base plate of said detent member; and screws for being threaded into said orifices to wedge said base plate against said strip projections as said screws are threaded into said orifices and contact said base portion of said channel.

* * * * *